United States Patent [19]

Jordan

[11] 4,101,025

[45] Jul. 18, 1978

[54] CARRYING CASE FOR WRENCHES

[76] Inventor: Ronald H. Jordan, 530 Hamilton St., Burlington, N.C. 27215

[21] Appl. No.: 813,875

[22] Filed: Jul. 8, 1977

[51] Int. Cl.[2] ..... B65D 85/20

[52] U.S. Cl. ..... 206/377; 150/7; 150/52 R

[58] Field of Search ..... 150/7, 52 R, 52 C; 206/372, 373, 376, 377, 378, 379

[56] References Cited

U.S. PATENT DOCUMENTS

| | | | |
|---|---|---|---|
| 1,171,896 | 2/1916 | Simpson | 206/373 |
| 1,183,800 | 5/1916 | Dalitz | 150/7 UX |
| 3,749,233 | 7/1973 | McCormick | 206/373 |
| 3,997,053 | 12/1976 | Bondhus | 206/377 |

*Primary Examiner*—Donald F. Norton

[57] ABSTRACT

A generally rectangular backing member is formed of a leather material and provided with a square, leather cover member, which is emplaced over the backing member and sewn thereto to overlie a portion thereof. Three sides of the cover member lie coextensively with three corresponding sides of the backing member and the fourth side of the cover member extends across the surface of the backing member between the side edges along an angular path with one side being substantially longer than the other side. The cover member is stitched to the backing member around the edges thereof, and includes a plurality of spaced or parallel stitch lines which connect the two members in such a way as to form a plurality of separate pockets therein. The backing member folds over and snaps closed to provide a sturdy, long-lasting case for hexagonal bar-type wrenches of differing size.

1 Claim, 2 Drawing Figures

CARRYING CASE FOR WRENCHES

BACKGROUND OF THE INVENTION

Hexagonal bar-type wrenches, commonly known as "Allen" wrenches, are conventionally sold in sets of eight to ten wrenches; each of a different size to fit a different size socket in the head of an "Allen" screw. Such wrenches are commonly marketed in plastic cases which are heat sealed along several spaced lines to form a plurality of pockets for the wrenches.

Such a case may be ideal for the home workman who uses his wrenches once a month, or, at the most, very sporadically. However, for a mechanic who utilizes his wrenches several times every day and is constantly putting wrenches in his case and taking them out, such cases are almost useless. They may last a day or two and that is the end of it.

SUMMARY OF THE PRESENT INVENTION

The present invention is directed, however, to providing a case of the type mentioned above for mechanics and is more sturdily constructed out of a superior material which should last for years, even with substantial daily use.

Such an approach utilizes leather as the material from which the case is made, and sews a separate backing member and cover member together with a thread of the type commonly used for sewing leather goods. A plurality of spaced, parallel stitches connect the backing member and cover member together along parallel lines to form pockets therein of differing sizes. A snap fastener is riveted or bradded to the upper portion of the backing member which eventually forms a cover flap, and to the central portion of the cover member so that the case may be closed and snapped together when desired.

It is therefore an object of the present invention to provide an improved mechanics' case for hexagonal bar wrenches which is more sturdily constructed for longer life.

Other objects and a fuller understanding of the invention will become apparent after reading the following detailed description of a preferred embodiment along with the accompanying drawings in which:

FIG. 1 is a perspective view illustrating the case in the open position according to the present invention; and FIG. 2 is a perspective view, similar to FIG. 1 except showing the case in the closed position.

DETAILED DESCRIPTION OF A PREFERRED EMBODIMENT

Figure 1:
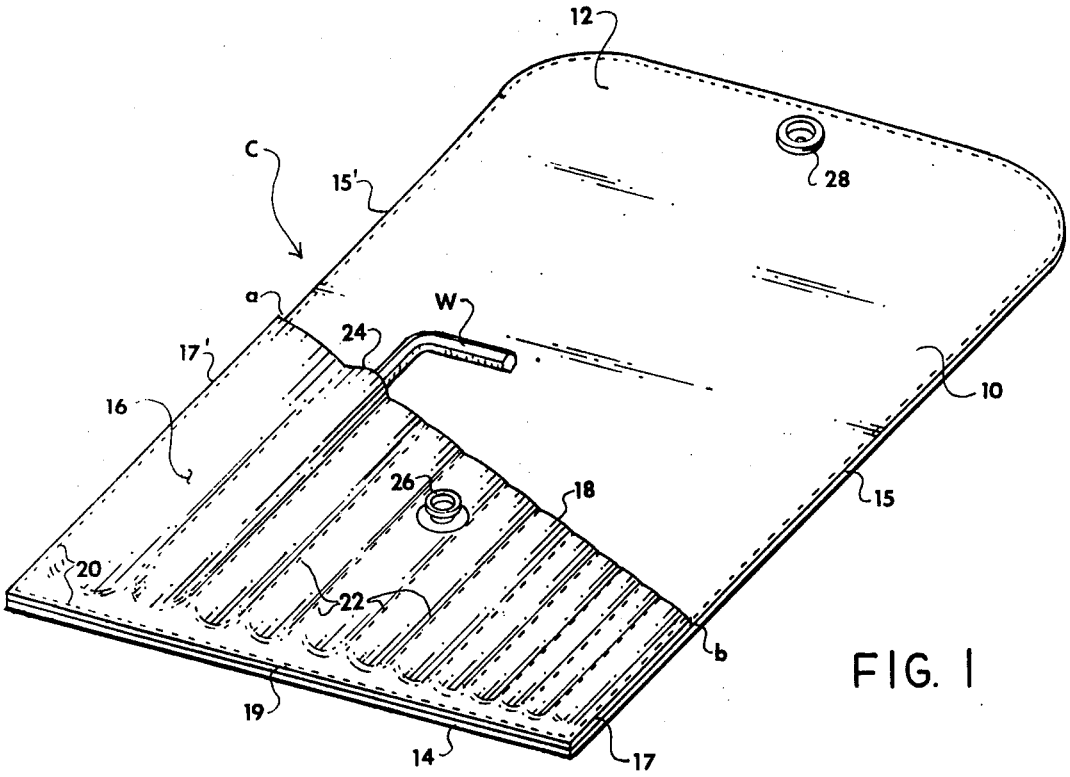
Figure 2:
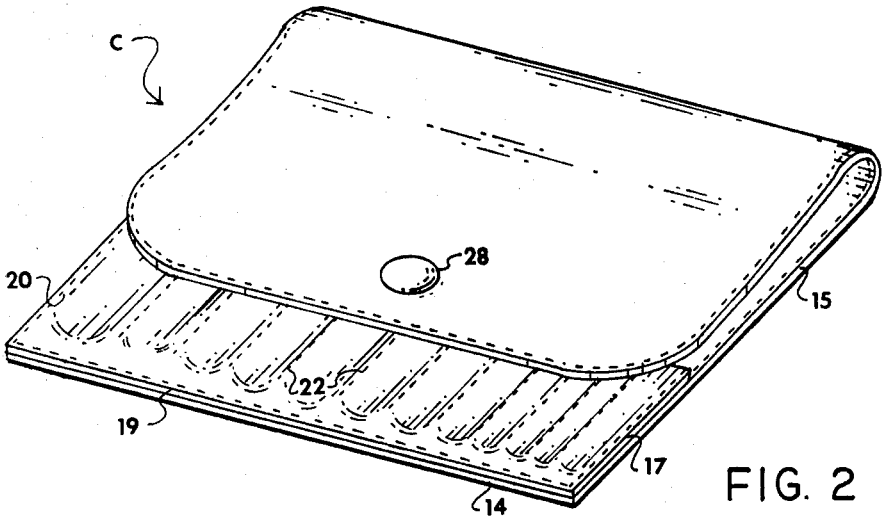

Turning now to the drawings there is illustrated the case C according to the present invention which includes a backing member 10 formed of a leather material and generally rectangular in shape. Backing member 10 includes an upper portion 12, a bottom edge 14, and a pair of spaced side edges 15, 15', and is approximately six inches in width and ten inches in length. The leather material is preferably at least one-sixteenth of an inch in thickness.

The cover member 16 is a flat piece formed of the same or a similar material, and is defined dimensionwise by side edges 17, 17', an upper edge 18, and a lower edge 19. The distance between side edges 17, 17' is substantially the same as the width of the backing member 10. The angular relation between the side edges 17, 17' and bottom edge 19 is such that when emplaced in overlying relationship on backing member 10, the bottom edge 19 is coextensive with the bottom edge 14 of the cover 10, and the side edges 17, 17' are coextensive with at least a portion of the side edges 15, 15' of the cover member.

The top edge 18 of cover member 16 extends across the surface of the backing member 10 commencing at a first point "*a*" on side edge 17' spaced above bottom edge 19 a first prescribed distance (approximately four inches) to a point of intersection "*b*" with the other side edge 17, which is spaced above the bottom edge a second, smaller distance (approximately one and one-half to two inches). So shaped, cover member 16 is in the shape of a right trapezoid.

Cover member 16 is stitched to backing member 10 along line 20 with a standard or conventional thread normally used when sewing leather pieces together. A plurality of linear stitches 22 connect the cover 16 and backing member 10 along parallel spaced lines between the side edges thereof to form a plurality of pockets 24 therein. Each of pockets 24 is adapted to receive a wrench W of a different size.

In use the upper end 12 of the backing member 10 is folded over and a male snap member 26 fastened to the cover 16 on backing member 10 by a rivet or brad receives the female portion 28 of the snap fastener, which in turn is similarly secured to the upper end 12 of the backing member.

While a preferred embodiment of the present invention has been illustrated and described hereinabove, it is apparent that various minor changes might be made without departing from the scope of the invention as set forth by the following claim.

What is claimed is:

1. A case for hexagonal bar wrenches comprising:

(a) a backing member formed of leather material and generally rectangular in shape, having a bottom edge, side edge, and an upper edge;

(b) a separate cover member also formed of leather material and in the shape of a right trapezoid, three sides of said cover member, when assembled, lying coextensively with three corresponding sides of backing member throughout a portion of the periphery of said backing member and the fourth side extending across the surface of said backing member between said side edges from a first point on one side edge spaced above said bottom edge a first distance to a second point on the other side edge spaced above said bottom edge a second, smaller distance;

(c) said cover member being stitched to said backing member with a sturdy thread around the coextensive sides and across the bottom, and a plurality of spaced parallel lines of stitches connecting said cover and said backing member, said lines of stitches extending from said fourth side downwardly toward said bottom edge forming a plurality of pockets therein; and (d) a snap connecting means having a male member secured to said cover member at a point centrally located and slightly below said fourth edge, and a female member secured to said backing member at a point centrally located between said side edges and slightly below said upper edge whereby the top portion of said backing member may be folded over and releasably secured to said male member covering the wrenches inserted in said pockets.

* * * * *